US009441812B2

(12) United States Patent
Liao et al.

(10) Patent No.: US 9,441,812 B2
(45) Date of Patent: Sep. 13, 2016

(54) ILLUMINATION APPARATUS

(71) Applicants: Chien-Chung Liao, Hsin-Chu (TW); Chi-Tang Hsieh, Hsin-Chu (TW); Fu-Ming Chuang, Hsin-Chu (TW)

(72) Inventors: Chien-Chung Liao, Hsin-Chu (TW); Chi-Tang Hsieh, Hsin-Chu (TW); Fu-Ming Chuang, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 7 days.

(21) Appl. No.: 14/493,374

(22) Filed: Sep. 23, 2014

(65) Prior Publication Data

US 2015/0362154 A1 Dec. 17, 2015

(30) Foreign Application Priority Data

Jun. 13, 2014 (TW) ..... 103120583 A

(51) Int. Cl.

| | |
|---|---|
| ***F21V 9/16*** | (2006.01) |
| ***F21V 13/08*** | (2006.01) |
| ***F21V 14/04*** | (2006.01) |
| ***F21V 9/10*** | (2006.01) |
| ***F21K 99/00*** | (2016.01) |
| ***F21S 8/10*** | (2006.01) |
| *F21Y 101/02* | (2006.01) |

(52) U.S. Cl.

CPC ..... *F21V 13/08* (2013.01); *F21K 9/56* (2013.01); *F21K 9/58* (2013.01); *F21S 48/1145* (2013.01); *F21S 48/1388* (2013.01); *F21S 48/1757* (2013.01); *F21V 9/10* (2013.01); *F21V 14/04* (2013.01); *F21Y 2101/025* (2013.01)

(58) Field of Classification Search

CPC ..... F21V 13/08; F21V 9/10; F21V 14/04; F21S 48/1388

See application file for complete search history.

(56) References Cited

U.S. PATENT DOCUMENTS

| | | | |
|---|---|---|---|
| 8,439,537 | B2 | 5/2013 | Nakazato et al. |
| 2011/0249460 | A1 | 10/2011 | Kushimoto |

(Continued)

FOREIGN PATENT DOCUMENTS

| | | |
|---|---|---|
| EP | 2781409 | 9/2014 |
| JP | 2006323391 | 11/2006 |

(Continued)

OTHER PUBLICATIONS

Office Action of Europe Counterpart Application issued on Oct. 27, 2015, p. 1-p. 7.

(Continued)

*Primary Examiner* — Andrew Coughlin
*Assistant Examiner* — Meghan Ulanday
(74) *Attorney, Agent, or Firm* — Jianq Chyun IP Office

(57) ABSTRACT

An illumination apparatus including an exciting light source, a reflective switching element, a first wavelength conversion element, and a second wavelength conversion element is provided. The exciting light source emits an exciting beam, and the reflective switching element is disposed on a transmission path of the exciting beam. When the reflective switching element is switched to a first state, the reflective switching element reflects the exciting beam to the first wavelength conversion element so as to excite the first wavelength conversion element to emit a first conversion beam. When the reflective switching element is switched to a second state, the reflective switching element reflects the exciting beam to the second wavelength conversion element so as to excite the second wavelength conversion element to emit a second conversion beam.

13 Claims, 3 Drawing Sheets

(56) References Cited

U.S. PATENT DOCUMENTS

| | | | |
|---|---|---|---|
| 2013/0027962 | A1 | 1/2013 | Takahashi et al. |
| 2014/0016322 | A1 | 1/2014 | Lu |

FOREIGN PATENT DOCUMENTS

| | | |
|---|---|---|
| JP | 2011142000 | 7/2011 |
| JP | 2011222238 | 11/2011 |
| JP | 2012063567 | 3/2012 |
| JP | 2014017094 | 1/2014 |
| WO | 2013099144 | 7/2013 |
| WO | 2013131730 | 9/2013 |

OTHER PUBLICATIONS

Office Action of Japan Counterpart Application, issued on Mar. 8, 2016, p. 1-p. 3.

ILLUMINATION APPARATUS

CROSS-REFERENCE TO RELATED APPLICATION

This application claims the priority benefit of Taiwan application serial no. 103120583, filed on Jun. 13, 2014. The entirety of the above-mentioned patent application is hereby incorporated by reference herein and made a part of this specification.

BACKGROUND OF THE INVENTION

1. Field of the Invention

The invention is related to an illumination apparatus, and more particularly to a laser illumination apparatus.

2. Description of Related Art

As technologies advance and more attention has been paid to environmental protection, the structure of a light source apparatus has evolved. For example, in recent years, headlights for vehicles with mainly solid state light source such as light emitting diode and laser diode have been increasingly developed in the market. The illumination efficiency of the light emitting diode is about 5% to 8% and has different color temperatures for selection with excellent power saving benefit. Since the laser diode has more than 20% of illumination efficiency, to deal with the limitation to the light source of the light emitting diode, a technique that utilizes laser light source to excite phosphor to generate applicable high efficiency light source has been gradually developed. The above two styles are current main streams of the light source for solid state illumination.

The technique that utilizes laser light source to excite the phosphor to emit light also has an advantage that the amount of the light source may be flexibly adjusted to achieve different headlight illuminance requirements. Therefore, the method is significantly potential under the structure of a headlight light source module, and is very likely to replace conventional high pressure mercury lamps in the future to become the light source of new main stream headlight illumination.

US patent publication No. 20110249460 discloses a vehicle headlight. U.S. Pat. No. 8,439,537 discloses a lighting fixture unit. US patent publication No. 20130027962 discloses a headlight system.

SUMMARY OF THE INVENTION

The invention provides an illumination apparatus which has a simple structure and may adjust the ratio of different conversion beams.

The objectives and advantages of the invention may be further understood in the technical features disclosed in the invention.

To achieve one or a part or all the objectives or other objectives, an embodiment of the invention provides an illumination apparatus, including an exciting light source, a reflective switching element, a first wavelength conversion element and a second wavelength conversion element. The exciting light source emits an exciting beam, and the reflective switching element is disposed on a transmission path of the exciting beam. When the reflective switching element is switched to a first state, the reflective switching element reflects the exciting beam to the first wavelength conversion element so as to excite the first wavelength conversion element to emit a first conversion beam. When the reflective switching element is switched to a second state, the reflective switching element reflects the exciting beam to the second wavelength conversion element so as to excite the second wavelength conversion element to emit a second conversion beam.

In an embodiment of the invention, the first wavelength conversion element and the second wavelength conversion element respectively include phosphors, and the concentration of the phosphor contained in the first wavelength conversion element is different from that contained in the second wavelength conversion element.

In an embodiment of the invention, the first wavelength conversion element and the second wavelength conversion element respectively include phosphors with different materials.

In an embodiment of the invention, the illumination apparatus further includes a reflective cover reflecting at least one of the first conversion beam and the second conversion beam.

In an embodiment of the invention, the reflective cover includes a first sub-reflective cover and a second sub-reflective cover. The first sub-reflective cover reflects the first conversion beam, and the second sub-reflective cover reflects the second conversion beam. After being reflected, the first conversion beam and the second conversion beam converge in a target region.

In an embodiment of the invention, the first wavelength conversion element is disposed approximately at a focus of the first sub-reflective cover, and the second wavelength conversion element is disposed approximately at a focus of the second sub-reflective cover.

In an embodiment of the invention, the illumination apparatus further includes a first reflector and a second reflector. When the reflective switching element is switched to the first state, the reflective switching element reflects the exciting beam to the first reflector, and the first reflector reflects the exciting beam to the first wavelength conversion element. When the reflective switching element is switched to the second state, the reflective switching element reflects the exciting beam to the second reflector, and the second reflector reflects the exciting beam to the second wavelength conversion element.

In an embodiment of the invention, the first wavelength conversion element and the second wavelength conversion element are disposed approximately at a focus of the reflective cover.

In an embodiment of the invention, the reflective switching element, the first wavelength conversion element and the second wavelength conversion element are disposed approximately at the focus of the reflective cover.

In an embodiment of the invention, the reflective cover has an opening, and the exciting beam from the exiting light source is transmitted to the reflective switching element via the opening.

In an embodiment of the invention, the illumination apparatus further includes a control unit electrically connected to the reflective switching element to control a ratio of a period in which the reflective switching element is switched to the first state to a period in which the reflective switching element is switched to the second state.

In an embodiment of the invention, the exciting light source is a laser light source.

In an embodiment of the invention, the reflective switching element is a micro-electromechanical system (MEMS) reflective mirror or an MEMS reflective mirror array.

In an embodiment of the invention, the illumination apparatus further includes a light transmissive cover disposed on the transmission paths of the first conversion beam and the second conversion beam from the reflective cover.

The embodiments of the invention may achieve at least one of the following advantages or effects. In the embodiments of the invention, since the illumination apparatus adopts the reflective switching element that may be switched to the first state and the second state, a ratio of the first conversion beam to the second conversion beam may be adjusted under a simple structure.

Other objectives, features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1A:
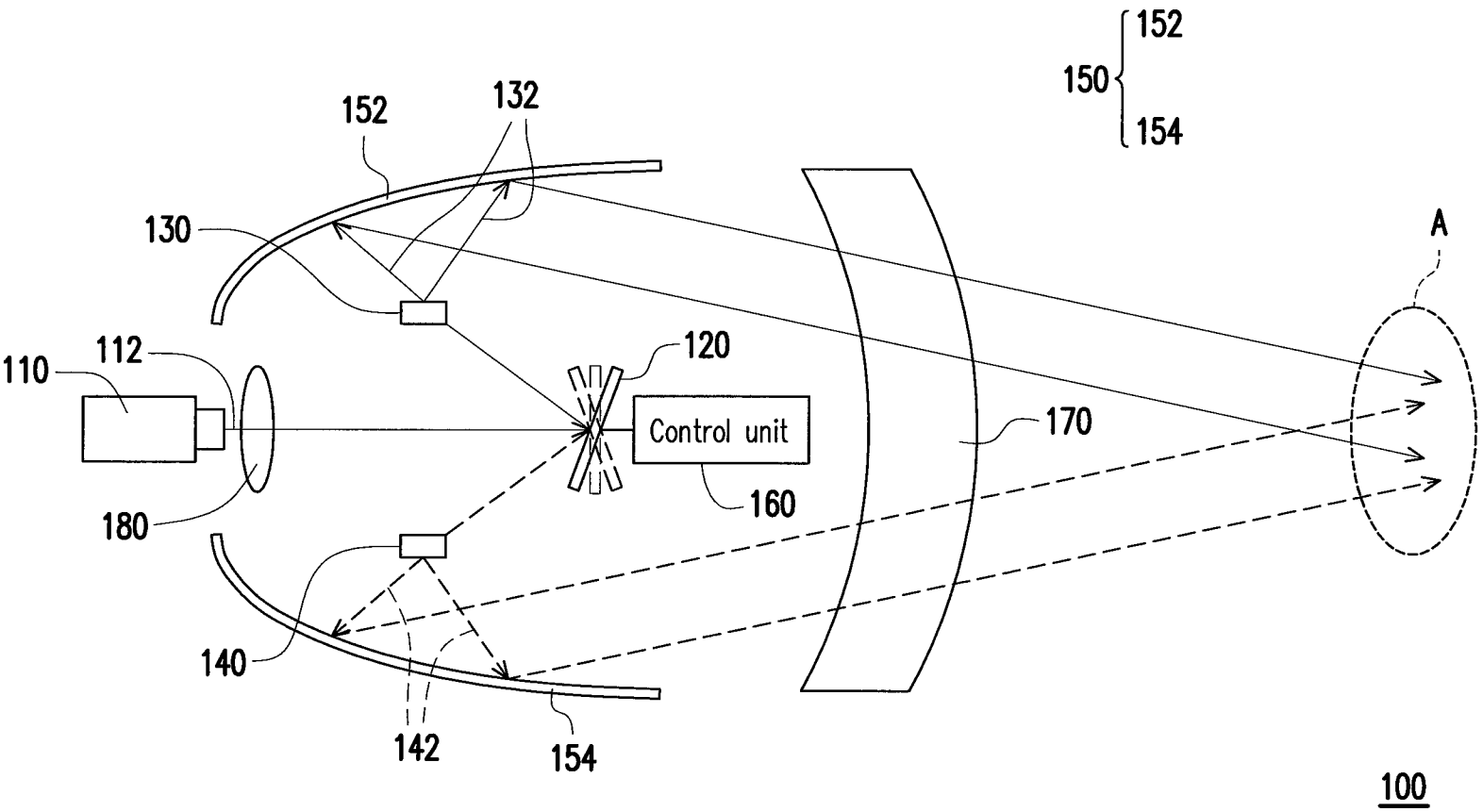
FIG. 1A is a schematic view illustrating a structure of an illumination apparatus according to an embodiment of the invention.
Figure 1B:
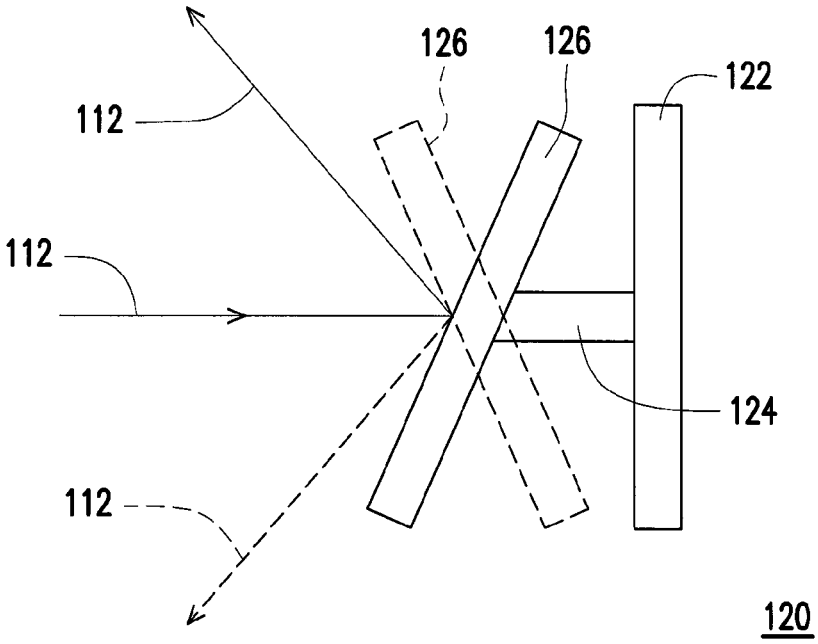
FIG. 1B is a schematic view illustrating a structure of a reflective switching element of FIG. 1A.

FIG. 1A is a schematic view illustrating a structure of an illumination apparatus according to an embodiment of the invention. FIG. 1B is a schematic view illustrating a structure of a reflective switching element of FIG. 1A. Please refer to FIGS. 1A and 1B. An illumination apparatus 100 of the embodiment includes an exciting light source 110, a reflective switching element 120, a first wavelength conversion element 130 and a second wavelength conversion element 140. The exciting light source 110 emits an exciting beam 112. In the embodiment, the exciting light source 110 is a laser light source. For example, the exciting light source 110 may include a single laser diode or a plurality of laser diodes arranged in an array; the exciting beam 112 is, for example, a laser beam. In addition, in the embodiment, the first wavelength conversion element 130 and the second wavelength conversion element 140 respectively include phosphors, and the concentration of the phosphor contained in the first wavelength conversion element 130 is different from that contained in the second wavelength conversion element 140.

The reflective switching element 120 is disposed on a transmission path of the exciting beam 112. When the reflective switching element 120 is switched to a first state (i.e. the solid line state shown in FIGS. 1A and 1B, i.e. a reflective mirror 126 of FIG. 1B has an angle indicated by the solid lines), the reflective switching element 120 (i.e. the reflective mirror 126) reflects the exciting beam 112 to the first wavelength conversion element 130 to excite the first wavelength conversion element 130 to emit a first conversion beam 132. When the reflective switching element 120 is switched to a second state (i.e. the dash line state shown in FIGS. 1A and 1B, i.e. the reflective mirror 126 of FIG. 1B has an angle indicated by the dash lines), the reflective switching element 120 reflects the exciting beam 112 to the second wavelength conversion element 140 to excite the second wavelength conversion element 140 to emit a second conversion beam 142.

For example, the exciting beam 112 is, for instance, a blue beam; the first wavelength conversion element 130 and the second wavelength conversion element 140 respectively include yellow phosphors with different concentration. In the embodiment, the concentration of the yellow phosphor contained in the first wavelength conversion element 130 is less than the concentration of the yellow phosphor contained in the second wavelength conversion element 140. Therefore, the first wavelength conversion element 130 converts a portion of the exciting beam 112 into a yellow beam, and the portion of the exciting beam 112 not being converted by the first wavelength conversion element 130 remains in the form of blue beam and is transmitted through the first wavelength conversion element 130. In addition, the portion of the exciting beam 112 not being converted by the first wavelength element 130 and the first conversion beam 132 are mixed to form a white beam.

On the other hand, the second wavelength conversion element 140 converts at least a portion of the exciting beam 112 into a yellow beam, and the portion of the exiting beam 112 not being converted by the second wavelength conversion element 140 remains in the form of blue beam and is transmitted through the second wavelength conversion element 140. Moreover, the portion of the exciting beam 112 not being converted by the second wavelength conversion element 140 and the second conversion beam 142 are mixed to form a white beam.

Since the concentration of the yellow phosphor contained in the first wavelength conversion element 130 is less than the concentration of the yellow phosphor contained in the second wavelength conversion element 140, the yellow color constituent in the white beam mixed by the exciting beam 112 from the first wavelength conversion element 130 and the first conversion beam 132 is less than the yellow color constituent in the white beam mixed by the exciting beam 112 from the second wavelength conversion element 140 and the second conversion beam 142. In other words, the color temperature of the white beam from the first wavelength conversion element 130 is higher than the color temperature of the white beam from the second wavelength conversion element 140. Besides, the reflective switching element 120 may be switched rapidly to the first state and the second state; by adjusting a ratio of a period during which the reflective switching element 120 is in the first state to a period during which the reflective switching element 120 is in the second state in a unit time, the color temperature of the white beam emitted by the illumination apparatus 100 may be adjusted.

In another embodiment, the first wavelength conversion element 130 and the second wavelength conversion element 140 respectively include phosphors with different materials. For example, the first wavelength conversion element 130 and the second wavelength conversion element 140 may emit different colors of the first conversion beam 132 and the second conversion beam 142 after being excited by the exciting beam 112. By adjusting a ratio of the period during which the reflective switching element 120 is in the first state to the period during which the reflective switching element is in the second state in a unit time, the color of the beam emitted by the illumination apparatus 100 may be adjusted.

In addition, when the concentration of the phosphor contained in the first wavelength conversion element 130 is so high that the exciting beam 112 can be completely absorbed, the light from the first wavelength conversion element 130 has the first conversion beam 132 only. However, when the concentration of the phosphor contained in the first wavelength conversion element 130 is insufficient for the exciting beam 112 to be completely absorbed by the first wavelength conversion element 130, a portion of the exciting beam 112 will be transmitted through the first wavelength conversion element 130 and be mixed with the first conversion beam 132. Likewise, when the concentration of the phosphor contained in the second wavelength conversion element 140 is so high that the exciting beam 112 can be completely absorbed, the light from the second wavelength conversion element 140 has the second conversion beam 142 only. However, when the concentration of the phosphor contained in the second wavelength conversion element 140 is insufficient for the exciting beam 112 to be completely absorbed by the second wavelength conversion element 140, a portion of the exciting beam 112 will be transmitted through the second wavelength conversion element 140 and be mixed with the second conversion beam 142.

The reflective switching element 120 is, for example, a micro-electromechanical system reflective mirror (as shown in FIG. 1B) that includes a base 122, a reflective mirror 126, and a connecting portion 124 that connects the base 122 and the reflective mirror 126. By applying voltage to cause electrostatistic attraction or repulsive force due to different polarities to be generated between the base 122 (such as the electrode on the base, not shown) and the reflective mirror 126, the reflective mirror 126 may swing between the first state and the second state and have different angles. In the embodiment, in the first state the reflective mirror 126 tilts by +10 degrees; in the second state the reflective mirror 126 tilts by −10 degrees, which should not be construed as a limitation to the invention.

Figure 2:
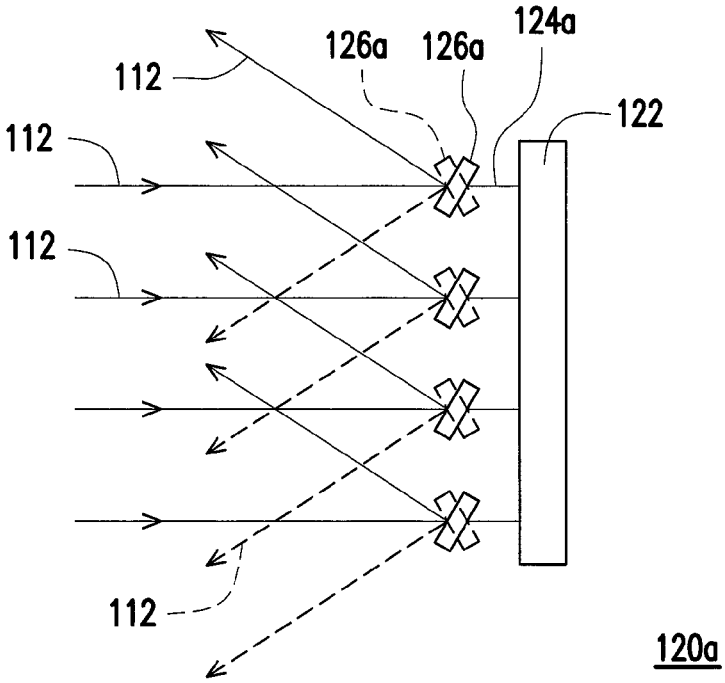
FIG. 2 shows a variation of the reflective switching element of FIG. 1B.

In another embodiment, the reflective switching element 120 of FIGS. 1A and 1B is replaced by a reflective switching element 120*a* of FIG. 2; please see FIGS. 1A and 2. In FIG. 2, the reflective switching element 120*a* is a micro-electromechanical system reflective mirror array which has a plurality of reflective mirrors 126*a* arranged in an array and a plurality of connecting portions 124*a* connecting the reflective mirrors 126*a* to the base 122. These reflective mirrors 126*a* may be switched between the first state and the second state. When the reflective mirrors 126*a* are switched to the first state, the reflective mirrors 126*a* reflect the exciting beam 112 generated by the exciting light source 110 to the first wavelength conversion element 130. When the reflective mirrors 126*a* are switched to the second state, the reflective mirrors 126*a* reflect the exciting beam 112 generated by the exciting light source 110 to the second wavelength conversion element 140. Accordingly, the reflective switching element 120*a* may achieve the effect of the reflective switching element 120. The reflective switching element 120*a* may also be a digital micro-mirror device. Alternatively, the reflective switching element 120*a* may be a micro-electromechanical system having less amount of pixels than a conventional digital micro-mirror device, which utilizes static electricity to control the reflective mirror 126*a* to deflect to the first state and the second state based on the same principle as that adopted by the digital micro-mirror device that controls the micro-reflective mirror to deflect to different angles. The difference lies in that the reflective mirror 126*a* has larger area than the micro-reflective mirror of the conventional digital micro-mirror device, and the amount of the reflective mirror 126*a* is fewer than the amount of the micro-reflective mirror of the conventional digital micro-mirror device. In addition, the principle based on which the reflective switching element 120 switches the reflective mirror 126 is the same as the principle based on which the digital micro-mirror element switches the micro-reflective mirror.

The illumination apparatus 100 may further include a reflective cover 150 reflecting at least one of the first conversion beam 132 and the second conversion beam 142. In the embodiment, the reflective cover 150 may reflect the first conversion beam 132, the second conversion beam 142 and the exiting beam 112 not being converted (in the case where a portion of the exciting beam 112 is not converted).

In the embodiment, the reflective cover 150 includes a first sub-reflective cover 152 and a second sub-reflective cover 154. The first sub-reflective cover 152 reflects a first conversion beam 132, and the second sub-reflective cover 154 reflects the second conversion beam 142; after being reflected, the first conversion beam 132 and the second conversion beam 142 converge in a target region A. When a portion of the exciting beam 112 is not converted, the first conversion beam 132, the second conversion beam 142 and the exciting beam 112 not being converted converge in the target region A.

In the embodiment, the illumination apparatus 100 further includes a control unit 160 electrically connected to the reflective switching element 120 to control the ratio of the period in which the reflective switching element 120 is switched to the first state to the period in which the reflective switching element 120 is switched to the second state. In other words, the color temperature or color of the beam emitted by the illumination apparatus 100 may be controlled by the control unit 160. The control unit 160 may use hardware (such as a digital logic circuit), software or firmware to control the reflective switching element 120.

In the embodiment, the first wavelength conversion element 130 is disposed approximately at a focus of the first sub-reflective cover 152, and the second wavelength conversion element 140 is disposed approximately at a focus of the second sub-reflective cover 154. In the embodiment, the first sub-reflective cover 152 and the second sub-reflective cover 154 are, for example, an ellipsoid reflective cover that allows the first conversion beam 132, the second conversion beam 142 and the exciting beam 112 not being converted to converge in the target region A. However, in other embodiments, the first sub-reflective cover 152 and the second sub-reflective cover 154 may also be a paraboloid reflective cover, a free-form surface reflective cover or a reflective cover having other suitable shapes.

In the embodiment, the illumination apparatus 100 utilizes the reflective switching element 120 that may be switched to the first state and the second state, and therefore the ratio of the first conversion beam 132 to the second conversion beam 142 may be adjusted under a simple structure, thereby achieving the adjustment to the light-emitting color temperature or light-emitting color. When the exciting light source 110 includes only one laser generating element (such as laser diode), the illumination apparatus 100 may still achieve the adjustment to the light-emitting color temperature or light-emitting color. If the illuminating apparatus 100 is to be applied in a high-luminance area, the exciting light source 110 may include a plurality of laser generating elements, and the amount of the laser generating elements may vary depending on the requirements. Furthermore, the illumination apparatus 100 of the embodiment may not use a combiner for combining a plurality of laser beams to the phosphor and therefore does not have the following drawbacks, including having a overly-large size, requiring high alignment accuracy, and that the combiner is likely to be over-heated to cause it difficult for the heat to be dissipated, leading to poor conversion rate of the phosphor and so on.

In the embodiment, a collimating lens 180 or a set of collimating lens may be disposed on the transmission path of the exciting beam 112 from the exciting light source 110 so the exciting beam 112 can be emitted toward the reflective switching element 120 in a collimated manner. In addition, in the embodiment, the illumination apparatus 100 further includes a light transmissive cover 170 disposed on the transmission paths of the first conversion beam 132 and the second conversion beam 142 from the reflective cover 150. Alternatively, when the exciting beam 112 is not completely absorbed, the light transmissive cover 170 may be disposed on the transmission path of the exciting beam 112. In the embodiment, the illumination apparatus 100 may be used as an illumination apparatus for vehicles such as a headlight, and the light transmissive cover 170 may be a light cover of the headlight. In addition, the target region A is, for example, an area with a road surface, a car in front, a building, an obstacle on the road.

Figure 3:
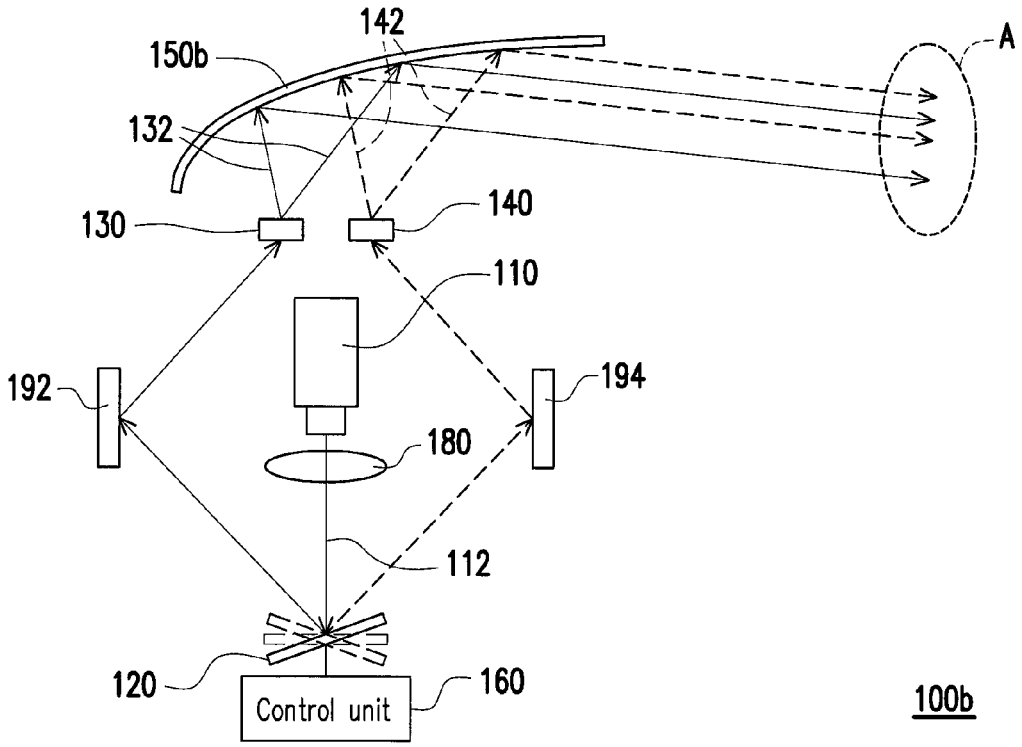
FIG. 3 is a schematic view illustrating a structure of an illumination apparatus according to another embodiment of the invention.

FIG. 3 is a schematic view illustrating a structure of an illumination apparatus according to another embodiment of the invention. Please refer to FIG. 3. In the embodiment, an illumination apparatus **100*b* is similar to the illumination apparatus 100 of FIG. 1A; the main differences are described below. In the embodiment, the illumination apparatus 100*b* further includes a first reflector 192 and a second reflector 194. When the reflective switching element 120 is switched to the first state, the reflective switching element 120 reflects the exciting beam 112 to the first reflector 192, and the first reflector 192 reflects the exciting beam 112 to the first wavelength conversion element 130. When the reflective switching element 120 is switched to the second state, the reflective switching element 120 reflects the exciting beam 112 to the second reflector 194, and the second reflector 194 reflects the exciting beam 112 to the second wavelength conversion element 140. In the embodiment, the first reflector 192 and the second reflector 194** are, for example, a reflective mirror or a reflective prism.

In addition, in the embodiment, the first wavelength conversion element 130 and the second wavelength conversion element 140 are disposed approximately at a focus of the reflective cover **150*b*. In the embodiment, the reflective cover 150*b* is, for example, an ellipsoid reflective cover. However, in other embodiments, the reflective cover 150*b*** may also be a paraboloid reflective cover, a free-form surface reflective cover or a reflective cover having other suitable shapes.

Figure 4:
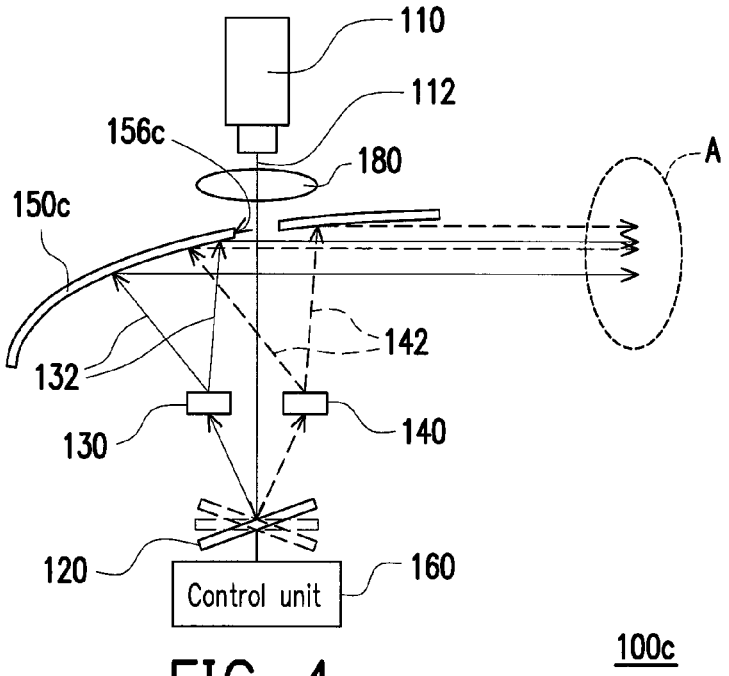
FIG. 4 is a schematic view illustrating a structure of an illumination apparatus according to another embodiment of the invention.

FIG. 4 is a schematic view illustrating a structure of an illumination apparatus according to another embodiment of the invention. Please refer to FIG. 4. In the embodiment, an illumination apparatus **100*c* is similar to the illumination apparatus of FIG. 1A; the main differences are described below. In the illumination apparatus 100*c* of the embodiment, the reflective cover 150*c* has an opening 156*c*, and the exciting beam 112 from the exciting light source 110 is transmitted to the reflective switching element 120 via the opening 156*c*. In addition, in the embodiment, the reflective switching element 120, the first wavelength conversion element 130 and the second wavelength conversion element 140 are all disposed approximately at a focus of the reflective cover 150*c*. In the embodiment, the reflective cover 150*c* may be an ellipsoid reflective cover. However, in other embodiments, the reflective cover 150*c*** may also be a paraboloid reflective cover, a free-form surface reflective cover or a reflective cover having other suitable shapes.

To sum up, the embodiments of the invention may achieve at least one of the following advantages or effects. In the embodiments of the invention, since the illumination apparatus adopts the reflective switching element that may be switched to the first state and the second state, the ratio of the first conversion beam to the second conversion beam may be adjusted under a simple structure, thereby adjusting the color temperature.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the invention is provided to comply with the rules requiring an abstract, which will allow a searcher to quickly ascertain the subject matter of the technical invention of any patent issued from this invention. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the invention as defined by the following claims. Moreover, no element and component in the invention is intended to be dedicated to the public regardless of whether the element or component is explicitly recited in the following claims.

What is claimed is:

1. An illumination apparatus, comprising:

an exciting light source emitting an exciting beam;

a reflective switching element disposed on a transmission path of the exciting beam;

a first wavelength conversion element;

a second wavelength conversion element, wherein the reflective switching element sequentially reflects the exciting beam to the first wavelength conversion element and the second wavelength conversion element, wherein the reflective switching element reflects the exciting beam to the first wavelength conversion element to excite the first wavelength conversion element to emit a first conversion beam when the reflective switching element is switched to a first state, and the reflective switching element reflects the exciting beam to the second wavelength conversion element to excite the second wavelength conversion element to emit a second conversion beam when the reflective switching element is switched to a second state; and a reflective cover reflecting at least one of the first conversion beam and the second conversion beam.

2. The illumination apparatus according to claim 1, wherein the first wavelength conversion element and the second wavelength conversion element comprise phosphors, respectively, and concentration of the phosphor contained in the first wavelength conversion element is different from concentration of the phosphor contained in the second wavelength conversion element.

3. The illumination apparatus according to claim 1, wherein the first wavelength conversion element and the second wavelength conversion element comprise phosphors of different materials, respectively.

4. The illumination apparatus according to claim 1, wherein the reflective cover comprises:

a first sub-reflective cover reflecting the first conversion beam; and a second sub-reflective cover reflecting the second conversion beam, wherein the first conversion beam and the second conversion beam converge in a target region after being reflected.

5. The illumination apparatus according to claim 4, wherein the first wavelength conversion element is disposed approximately at a focus of the first sub-reflective cover, and the second wavelength conversion element is disposed approximately at a focus of the second sub-reflective cover.

6. The illumination apparatus according to claim 1, further comprising:

a first reflector, wherein the reflective switching element reflects the exciting beam to the first reflector when the reflective switching element is switched to the first state, and the first reflector reflects the exciting beam to the first wavelength conversion element; and a second reflector, wherein the reflective switching element reflects the exciting beam to the second reflector when the reflective switching element is switched to the second state, and the second reflector reflects the exciting beam to the second wavelength conversion element.

7. The illumination apparatus according to claim 6, wherein the first wavelength conversion element and the second wavelength conversion element are disposed approximately at a focus of the reflective cover.

8. The illumination apparatus according to claim 1, wherein the reflective switching element, the first wavelength conversion element and the second wavelength conversion element are all disposed approximately at a focus of the reflective cover.

9. The illumination apparatus according to claim 1, wherein the reflective cover has an opening, and the exciting beam from the exciting light source is transmitted to the reflective switching element via the opening.

10. The illumination apparatus according to claim 1, further comprising a control unit electrically connected to the reflective switching element to control a ratio of a period in which the reflective switching element is switched to the first state to a period in which the reflective switching element is switched to the second state.

11. The illumination apparatus according to claim 1, wherein the exciting light source is a laser light source.

12. The illumination apparatus according to claim 1, wherein the reflective switching element is a micro-electromechanical system reflective mirror or a micro-electromechanical system reflective mirror array.

13. The illumination apparatus according to claim 1, further comprising a light transmissive cover disposed on transmission paths of the first conversion beam and the second conversion beam from the reflective cover.

* * * * *